US007993214B2

(12) United States Patent
Hirano

(10) Patent No.: US 7,993,214 B2
(45) **Date of Patent: *Aug. 9, 2011**

(54) GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 226 days.

This patent is subject to a terminal disclaimer.

(21) Appl. No.: 12/348,945

(22) Filed: Jan. 6, 2009

(65) Prior Publication Data

US 2009/0253533 A1 Oct. 8, 2009

(30) Foreign Application Priority Data

Apr. 3, 2008 (JP) ..... 2008-097402

(51) Int. Cl.
*A63B 53/04* (2006.01)

(52) U.S. Cl. ..... 473/329; 473/342; 473/345

(58) Field of Classification Search ..... 473/324–350
See application file for complete search history.

(56) References Cited

U.S. PATENT DOCUMENTS

| | | | | |
|---|---|---|---|---|
| 2,087,685 | A * | 7/1937 | Hackney | 473/349 |
| 6,899,638 | B2 | 5/2005 | Iwata et al. | |
| 6,997,820 | B2 * | 2/2006 | Willett et al. | 473/329 |
| 7,220,190 | B2 * | 5/2007 | Hirano | 473/342 |
| 7,481,717 | B2 * | 1/2009 | Knuth | 473/329 |
| 7,578,755 | B2 * | 8/2009 | Oyama | 473/342 |
| 7,607,992 | B2 * | 10/2009 | Nishio | 473/342 |
| 7,614,964 | B2 * | 11/2009 | Matsunaga | 473/342 |
| 7,618,331 | B2 * | 11/2009 | Hirano | 473/329 |
| 7,713,140 | B2 * | 5/2010 | Gibbs et al. | 473/329 |
| 7,749,102 | B2 * | 7/2010 | Nakamura | 473/342 |
| 2003/0144079 | A1 | 7/2003 | Yoneyama | |
| 2008/0248896 | A1 * | 10/2008 | Hirano | 473/346 |

FOREIGN PATENT DOCUMENTS

| | | | |
|---|---|---|---|
| JP | 08155060 | A * | 6/1996 |
| JP | 10137372 | A * | 5/1998 |
| JP | 2001286586 | A * | 10/2001 |
| JP | 2002045445 | A * | 2/2002 |
| JP | 2003154040 | A * | 5/2003 |
| JP | 2003245384 | A * | 9/2003 |
| JP | 2006-175135 | A | 7/2006 |
| JP | 2007097647 | A * | 4/2007 |
| JP | 2009247497 | A * | 10/2009 |

* cited by examiner

*Primary Examiner* — Alvin A Hunter
(74) *Attorney, Agent, or Firm* — Birch, Stewart, Kolasch & Birch, LLP

(57) ABSTRACT

A golf club head is provided with a face portion comprising: a central thick part having a thickness Tc; a crown-side thick part having a thicknesses Tr; a sole-side thick part having a thicknesses Tr; a toe-side thinner part having a thickness TT; and a heel-side thinner part having a thickness TH, wherein: (1) Tc>=Tr>TT and (2) Tr>TH are satisfied; and the centroid of the central thick part is positioned on the toe-side of an extension of a widthwise center line of the crown-side thick part towards the sole and further positioned on the heel-side of an extension of a widthwise center line of the sole-side thick part towards the crown.

6 Claims, 9 Drawing Sheets

Ref.1

Ref.2

Ref.3

Ref.4

GOLF CLUB HEAD

BACKGROUND OF THE INVENTION

The present invention relates to a golf club head having a hollow behind the face portion, more particularly to a structure of the face portion provided with a specific thickness distribution.

Recently, there have been widely used wood-type hollow golf club heads whose face portion is made of a thin metal material in order to increase carry and reduce the weight of the face portion, while providing a thicker central region to provide necessary strength and durability.

In this structure, since the central region is surrounded by the relatively thin region, there is a tendency that a large stress at impact tends to concentrate on the upper edge and lower edge of the face portion (namely, annular thin region) because, in comparison with the toe-side edge and heel-side edge, the upper and lower edges are approximate to the central region which is moved largely at impact.

United States Patent Application Publication No. US-2003-144079-A1 discloses a wood-type golf club head, wherein, in order to increase the strength of the face portion, the thin region surrounding a thick central region is provided with narrow ribs extending radially from the central thick region.

Japanese Patent Application Publication No. P2006-175135A discloses a golf club head whose face portion is provided with a thicker part in order to minimize the difference in carry distance between sweet spot shots and off-center shots towards the heel and toe, wherein the thicker part is disclosed as having a thickness of 4 mm to 10 mm and extending almost parallel to the vertical direction with a substantially constant width, and the resultant thin part of the face portion is disclosed as having a thickness of less than 2.5 mm.

On the other hand, according to a research made by the present inventor et al., as shown in FIG. 3, hitting positions of average golfers have a tendency to distribute along a straight line N extending between the toe and heel at an inclination angle of about 20 to 30 degrees with respect to the horizontal direction.

Therefore, in view of such distribution, there is plenty of scope for minimizing the above-mentioned difference in the carry distance and improving the strength and durability of the face portion, while the reduced overall thickness of the face portion is maintained, and a large variation of the thickness is restrained for easier manufacturing.

SUMMARY OF THE INVENTION

It is an object of the present invention to provide a golf club head, in which the difference in carry distance between sweet spot shots and off-center shots can be minimized, and the durability of the face portion can be improved.

According to the present invention, a golf club head is provided with a hollow structure comprising a face portion of which front surface forms a clubface, a crown portion, a sole portion and a side portion between the crown portion and sole portion, the face portion comprising:

a central thick part;

a crown-side thick part extending from the central thick part toward the crown portion;

a sole-side thick part extending from said central thick part towards the sole portion;

a toe-side thinner part formed on the toe-side of the crown-side thick part, central thick part and sole-side thick part; and a heel-side thinner part formed on the heel-side of the crown-side thick part, central thick part and sole-side thick part, wherein a thickness Tc of the central thick part, thicknesses Tr of the crown-side thick part and sole-side thick part, a thickness TT of the toe-side thinner part, and a thickness TH of the heel-side thinner part satisfy the following conditional expressions: (1) Tc>=Tr>TT, and (2) Tr>TH, and a centroid of the central thick part is positioned on the toe-side of an extension of a widthwise center line of the crown-side thick part towards the sole portion, and on the heel-side of an extension of a widthwise center line of the sole-side thick part towards the crown portion.

Therefore, the crown-side and sole-side thick parts can mitigate the stress concentration on the upper and lower edges of the face portion, and effectively improve the durability.

Since the crown-side thick part and the sole-side thick part are staggered about the central thick part, the reinforcing effect to the central thick part becomes moderate when compared with those arranged in line as shown in FIG. 12. And accordingly, the deflection of the face portion at sweet-spot shot is increased to increase the coefficient of restitution.

Further, the deflection of the toe-side thinner part upon off-center shot towards the toe, and the deflection of the heel-side thinner part upon off-center shot towards the heel becomes even, and approximates to the deflection of the central thick part upon sweet-spot shot. Therefore, the variation of the coefficient of restitution due to the variation of the ball hitting position is decreased.

Furthermore, due to the staggered arrangement, the reinforcing effect spreads widely in the toe-heel direction, therefore, even if the ball hitting position becomes off-centered towards the crown or sole, an appropriate deflection of the face portion can be obtained, and the loss of the carry distance is lessened.

In this specification, sizes, positions, directions and the like relating to the club head refer to those under a standard state of the club head unless otherwise noted.

Here, the standard state of the club head is such that the club head is set on a horizontal plane HP so that the center line CL of the club shaft (not shown) is inclined at the lie angle (alpha) while keeping the club shaft center line CL on a vertical plane VP, and the clubface forms its loft angle with respect to the horizontal plane HP. Incidentally, in the case of the club head alone, the center line of the shaft inserting hole can be used instead of the center line of the club shaft.

Sweet spot Ss is the point of intersection between the clubface and a straight line NL drawn normally to the clubface passing the center of gravity G of the head.

Front-back direction is a direction parallel with the above-mentioned straight line NL projected on the horizontal plane HP.

Toe-heel direction is a direction TH parallel with the horizontal plane HP and parallel with the vertical plane VP.

Crown-sole direction is a direction Cs perpendicular to the horizontal plane HP, namely, the vertical direction.

Areas of the front surface and back surface of the face portion and various parts refer to the areas projected on the vertical plane VP unless otherwise noted.

DESCRIPTION OF THE PREFERRED EMBODIMENTS

Figure 1:
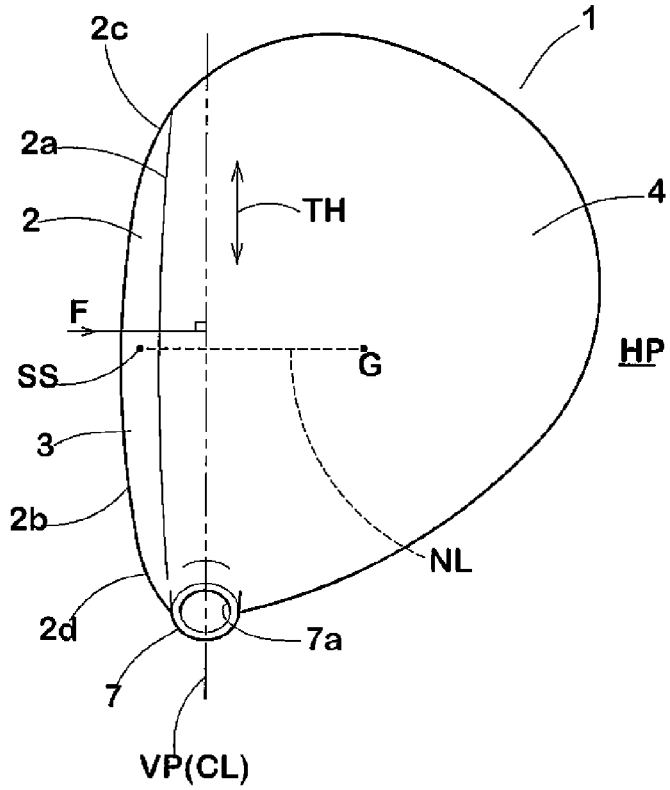
FIG. 1 is a top view of a club head according to the present invention.
Figure 2:
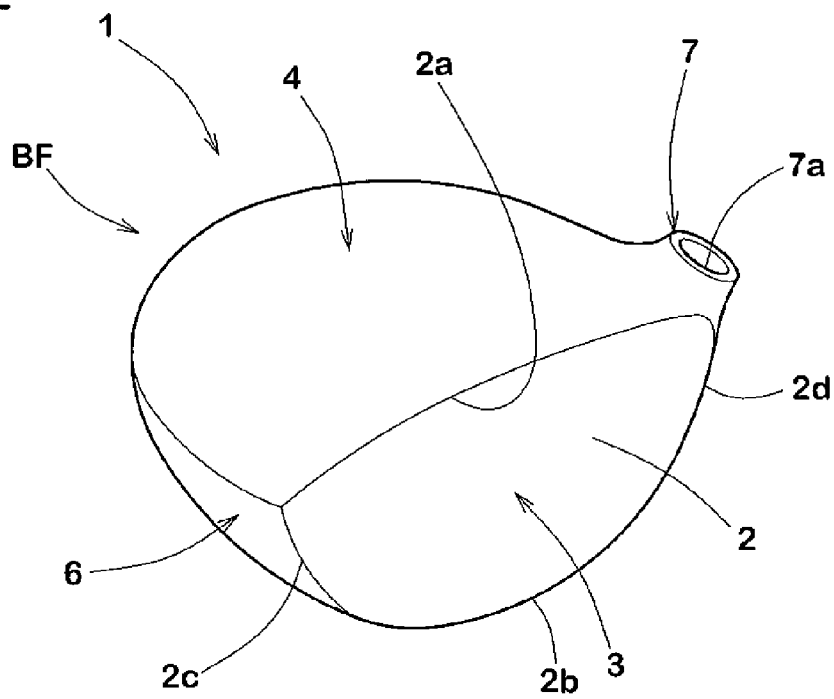
FIG. 2 is a perspective view thereof.
Figure 3:
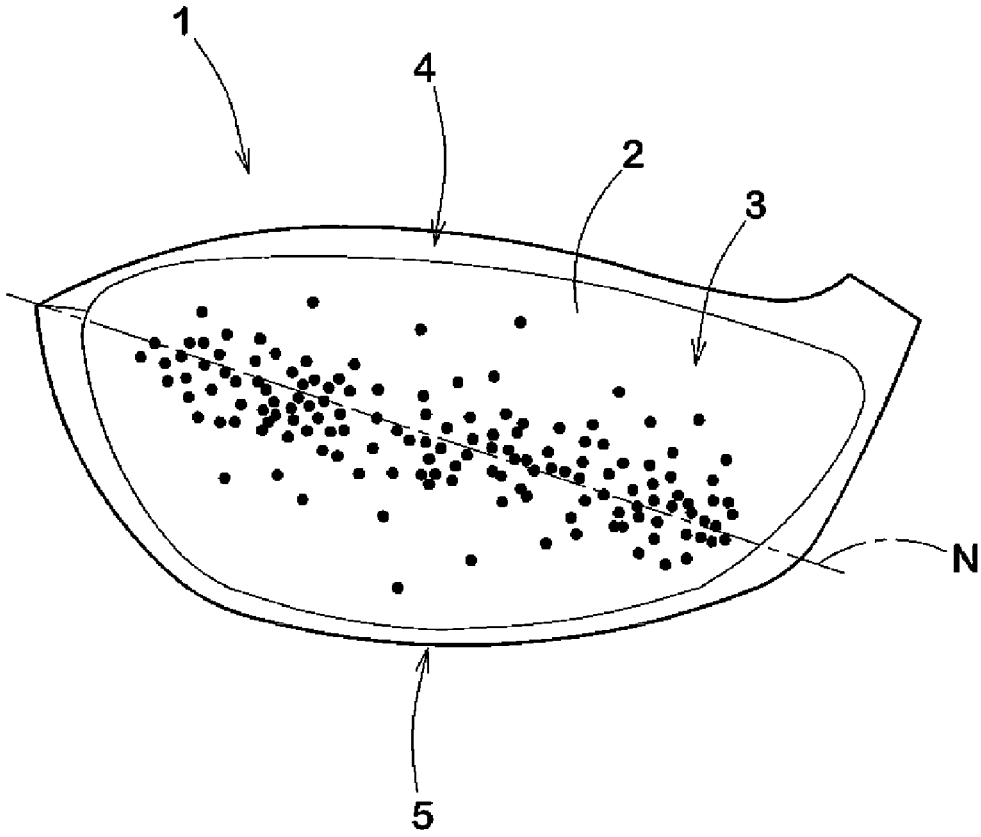
FIG. 3 is a front view thereof and a distribution map of ball hitting positions of average golfers.

Embodiments of the present invention will now be described in detail in conjunction with accompanying drawings.

In the drawings, golf club head 1 according to the present invention is a hollow head for a wood-type golf club such as driver (#1) or fairway wood.

The head 1 comprises: a face portion 3 whose front surface defines a clubface 2 for hitting a ball; a crown portion 4 intersecting the clubface 2 at the upper edge 2*a* thereof; a sole portion 5 intersecting the clubface 2 at the lower edge 2*b* thereof; a side portion 6 between the crown portion 4 and sole portion 5 which extends from a toe-side edge 2*c* to a heel-side edge 2*d* of the clubface 2 through the back face BF of the club head; and a hosel portion 7 provided with a shaft inserting hole 7*a* and positioned at the heel-side end of the crown to be attached to an end of a club shaft (not shown) inserted into the shaft inserting hole 7*a*. Thus, the club head 1 has a shell structure with the thin wall and a hollow (i) behind the face portion 3. In this embodiment, the hollow (i) is void, but a filler, e.g. foamed plastic and the like can be disposed therein so as not to contact with the face portion 3.

Preferably, the volume of the head 1 is set in a range of not less than 380 cc, more preferably not less than 400 cc, still more preferably not less than 420 cc in order to increase the moment of inertia and the depth of the center of gravity to improve the directionality of the hit ball. However, to prevent an excessive increase in the club head weight and deteriorations of swing balance and durability and further in view of golf rules or regulations, the head volume is preferably set in a range of not more than 470 cc, more preferably not more than 460 cc.

The mass of the club head 1 is preferably set in a range of not less than 180 grams, more preferably not less than 185 grams in view of the strength and swing balance, but not more than 220 grams, more preferably not more than 215 grams in view of the directionality and traveling distance of the ball.

The club head 1 can be a two- or three- or four-piece structure.

In this embodiment, a two-piece structure is adopted, which comprises: a main body 1B made of at least one kind of metal material; and a face plate 1A made of a metal material and attached to the front of the main body 1B by welding so as to cover the front opening O of the main shell 1B.

Figure 4:
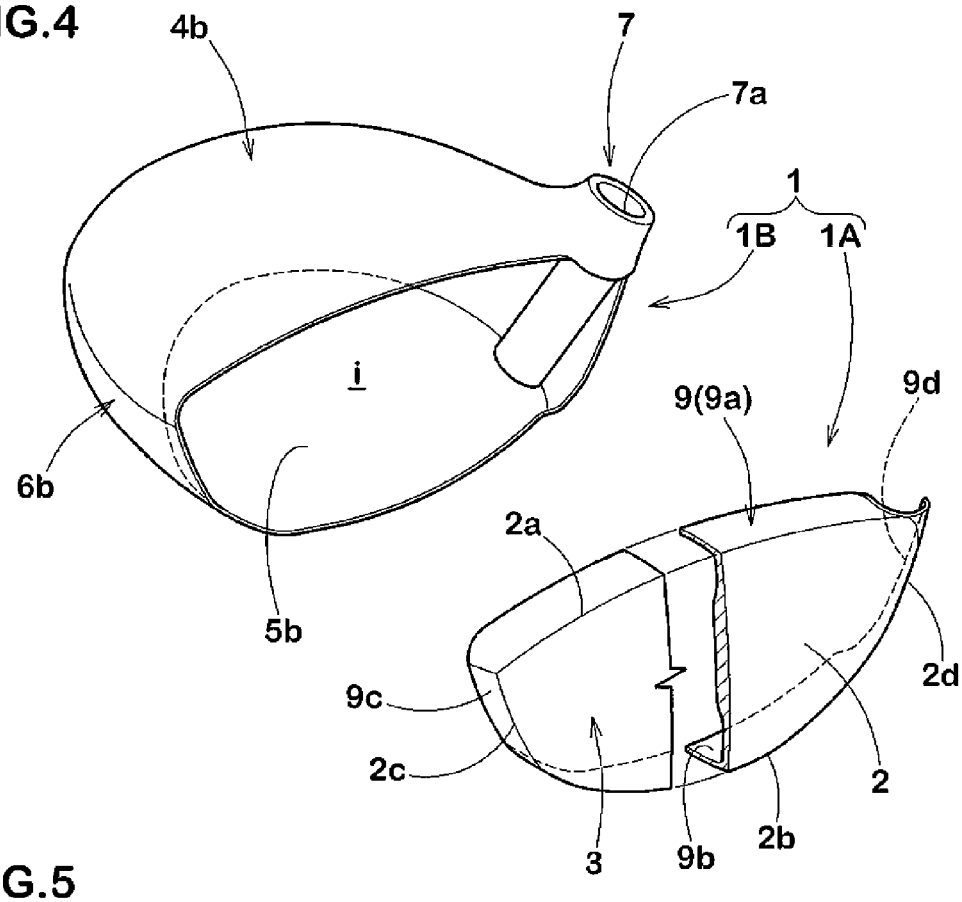
FIG. 4 is an exploded perspective view showing a two-piece structure for the head.
Figure 5:
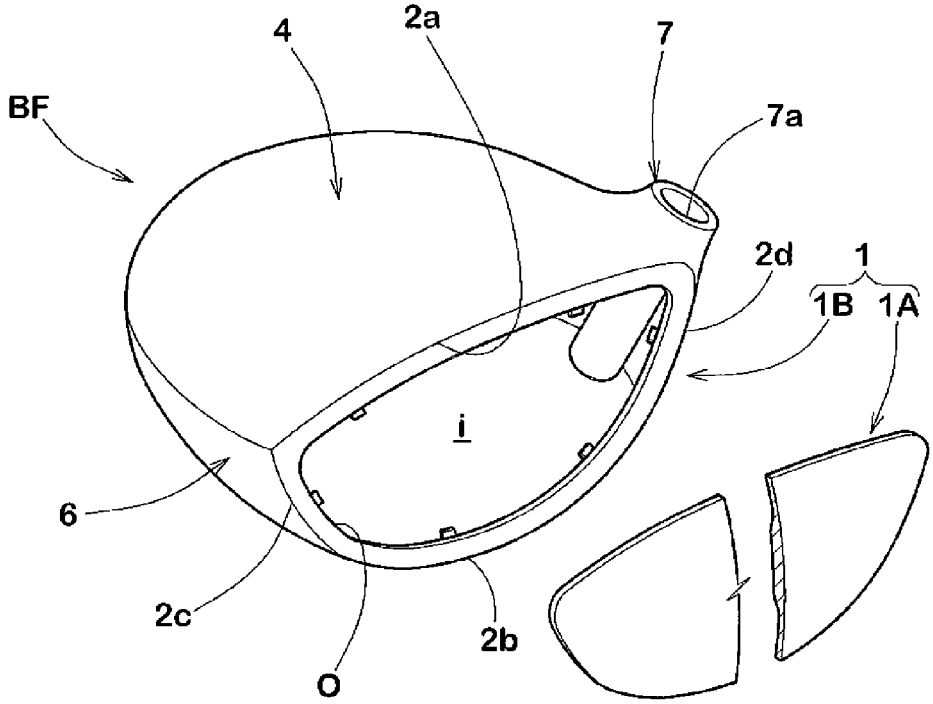
FIG. 5 is an exploded perspective view showing another example of the two-piece hollow structure.

For example, as shown in FIG. 5, the face plate 1A can be a slightly curved plate without the undermentioned turnback. But, in this embodiment, as shown in FIG. 4, the face plate 1A is provided along the edges 2*a*, 2*b*, 2*c* and 2*d* of the club face 2 with backwardly extending turnbacks 9*a*, 9*b*, 9*c* and 9*d*, and forms the entirety of the face portion 3.

Since the turnbacks 9*a*, 9*b*, 9*c* and 9*d* form the front zones of the respective portions 3, 4 and 5, the main body 1B forms the remainder of the club head. Namely, the main body 1B is integrally made up of: a major posterior part 4*b* of the crown portion 4; a major posterior part 5*b* of the sole portion 5; a major posterior part 6*b* of the side portion 6; and the hosel portion 7.

In any case, the face plate 1A and main body 1B are preferably made of metal materials having large specific tensile strength. Specifically, stainless steels, maraging steels, pure titanium, titanium alloys, magnesium alloys, aluminum alloys can be preferably used. As to the titanium alloys, Ti-6Al-4V, Ti-15V-3Cr-3Al-3Sn, Ti-15Mo-5Zr-3Al, Ti-13V-11Cr-3Al or the like can be preferably used.

The face plate 1A and the main shell 1B can be made of the same metal materials, but it is also possible that these are made out of different metal materials.

Incidentally, in order to reduce the weight of the club head 1, a fiber reinforced resin may be used to form a part of the main shell 1B. The face plate 1A can be made through a plastic deformation process, for example, hot forging of a round bar of the metal material, or mold pressing of a rolled sheet of the metal material or the like. As to the welding, plasma welding, Tig welding and laser welding are preferably used.

The face portion 3 has, as usual, a contour shape longer in the toe-heel direction than in the crown-sole direction. The front surface of the face portion 3 is flat excepting small grooves or punch marks (not shown) provided in the clubface 2. The back surface 3B of the face portion 3 is provided with a patterned indentation in order to provide a specific thickness distribution for the face portion 3.

The face portion 3 is therefore, provided with:

- a central thick part 10 formed at the center of the clubface 2;
- a crown-side thick part 11 extending from the central thick part 10 to the crown portion 4;
- a sole-side thick part 12 extending from the central thick part 10 to the sole portion 5;
- a toe-side thinner part 13 positioned on the toe-side of the thick parts 10, 11 and part 12; and
- a heel-side thinner part 14 positioned on the heel-side of the thick parts 10, 11 and part 12.

The thickness Tc of the central thick part 10, the thickness Tr of the crown-side thick part 11 and sole-side thick part 12, the thickness TT of the toe-side thinner part 13, and the thickness TH of the heel-side thinner part 14 satisfy the following conditional expressions (1) and (2):

$$Tc >= Tr > TT \quad (1)$$

$$Tr > TH \quad (2)$$

Figure 7:
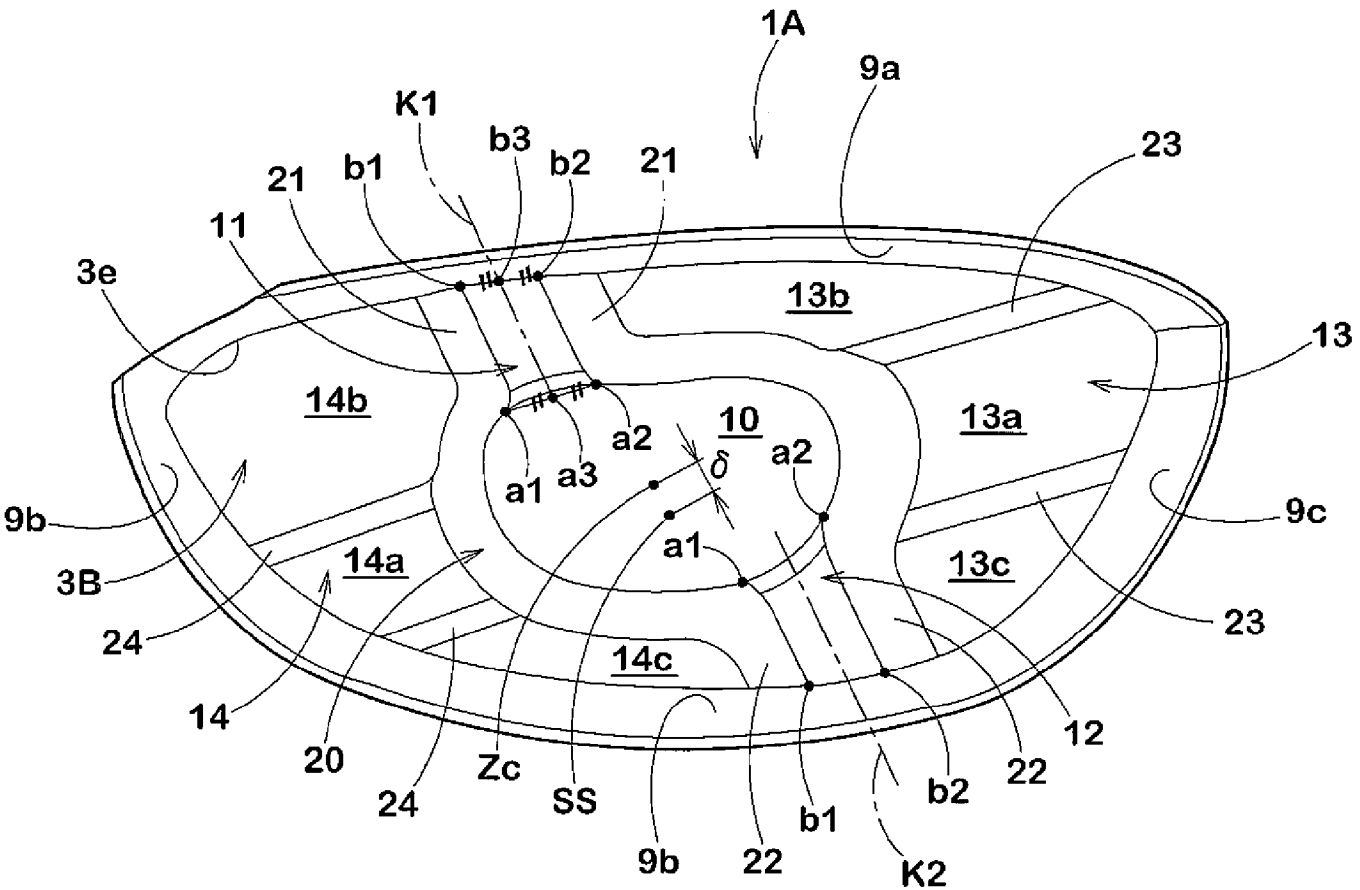

The central thick part 10 has an outline shape which is generally an ellipse or oval long in the toe-heel direction and roughly similar to but smaller than the contour shape of the clubface 2. The central thick part 10 is, as shown in FIG. 7, positioned such that the distance δ of the centroid Zc thereof measure from the sweet spot SS is not more than 7 mm, preferably not more than 5 mm, more preferably not more than 3 mm.

The central region of the face portion 3 receives large impulsive forces on sweet-spot shots, therefore, in order to provide sufficient durability for the face portion 3, the central thick part 10 is provided with the largest thickness Tc. Preferably, the thickness Tc is not less than 3.10 mm, more preferably not less than 3.25 mm, but not more than 4.00 mm, more preferably not more than 3.85 mm.

The thickness Tc is substantially constant.

If the thickness Tc is more than 4.00 mm, the coefficient of restitution and the depth of the center of gravity of the head are liable to decrease, and deterioration in directionality of hit balls tends to occur.

If the area Ac of the central thick part 10 is very small, the durability of the face portion 3 deteriorates, therefore, the area Ac is preferably not less than 13%, more preferably not less than 15% of the overall area of the back surface 3B of the face portion 3. However, if the area Ac is very large, it is difficult to improve the coefficient of restitution and the directionality of the hit ball, therefore, the area Ac is preferably not more than 30%, more preferably not more than 25%, still more preferably not more than 23% of the overall area of the back surface 3B of the face portion 3.

Here, the overall area of the back surface 3B is preferably set in a range of not less than 36 sq·cm, more preferably not less than 38 sq·cm, but not more than 47 sq·cm, more preferably not more than 45 sq·cm.

The overall area of the back surface 3B is almost same as the overall area of the clubface.

The thicknesses Tr of the crown-side thick part 11 and the sole-side thick part 12 are equal to or less than the thickness Tc of the central thick part 10.

The thickness Tr of the crown-side thick part 11 can be differed from the thickness Tr of the sole-side thick part 12, for example, the sole-side thick part 12 can be thicker than the crown-side thick part 11. In this embodiment, however, the thickness Tr of the crown-side thick part 11 is substantially same as the thickness Tr of the sole-side thick part 12.

In either case, each of the thicknesses Tr is substantially constant.

If the crown-side thick part 11 and sole-side thick part 12 are thicker than the central thick part 10, then the coefficient of restitution of the face portion 3 is greatly decreased, thus it is not preferable. Especially, the rigidity of the peripheral part of the central thick part 10 is increased, and thereby the carry distance on miss shots is decreased remarkably. On the other hand, if the crown-side thick part 11 and sole-side thick part 12 are too thin, then there is a possibility that the durability of the face portion 3 decreases. In this light, the thicknesses Tr of the crown-side thick part 11 and the sole-side thick part 12 are preferably not less than 90%, more preferably not less than 93% of the thickness Tc of the central thick part 10.

Figure 6:
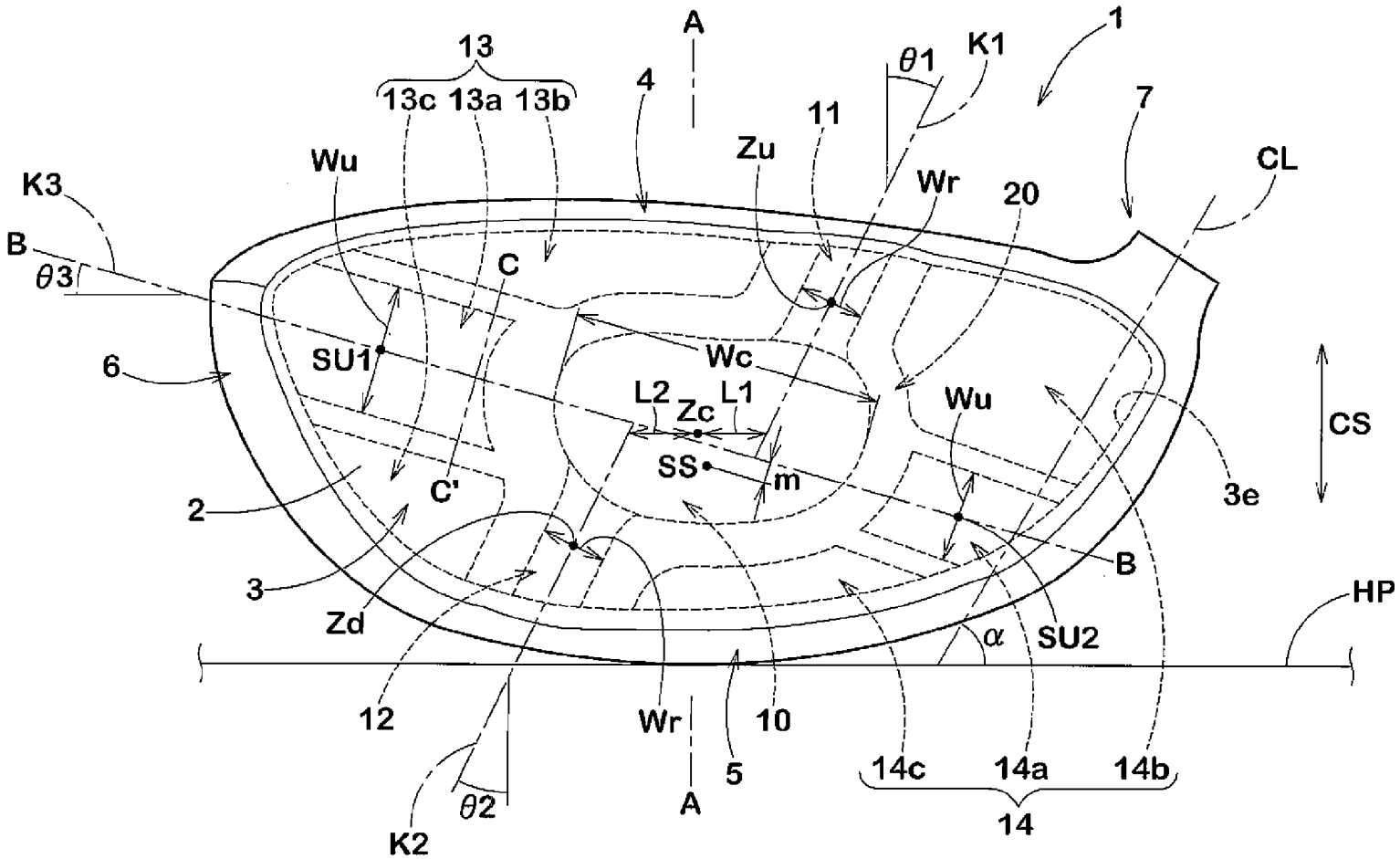
FIG. 6 and FIG. 7 are a front view and a rear view of the face portion showing a patterned indentation provided on the back surface of the face portion.

In the front view of the head under the standard state as shown in FIG. 6, the extension K1 of the widthwise center line of the crown-side thick part 11 towards the sole portion 5 passes through on the heel-side of the centroid Zc of the central thick part 10, and the extension K2 of the widthwise center line of the sole-side thick part 12 towards the crown portion 4 passes through on the toe-side of the centroid Zc of the central thick part 10.

In other words, the centroid Zc of the central thick part 10 is positioned on the toe-side of the extension K1 and on the heel-side of the extension K2.

As shown in FIG. 7, the widthwise center line of the thick part 11, 12 can be defined by a straight line a3-b3 extending between two points a3 and b3, wherein the point a3 is the middle point of a straight line a1-a2 drawn between two intersecting points a1 and a2 of the edges of the thick part 11,12 and the edge of the central thick part 10, and the point b3 is the middle point of a straight line b1-b2 drawn between two intersecting points b1 and b2 of the edges of the thick part 11,12 and the edge 3*e* of the back surface 3B.

Figure 8:
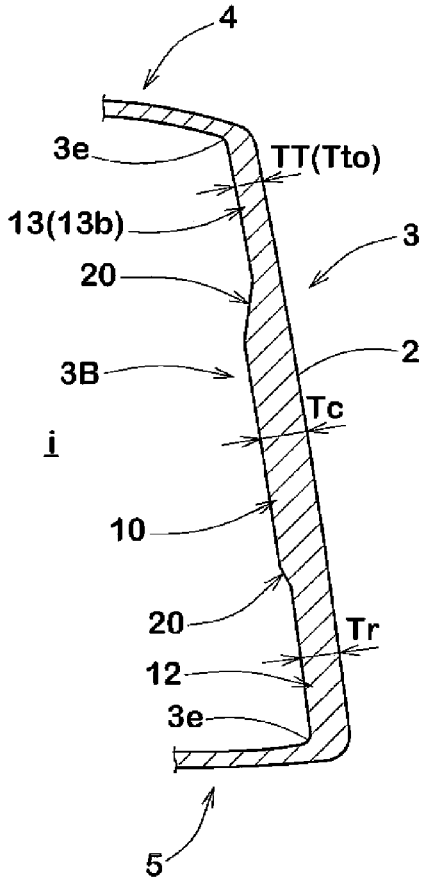
FIG. 8 is a cross sectional view taken along line A-A of FIG. 6.

The edge 3*e* of the back surface 3B of the face portion 3 is, as shown in FIGS. 7 and 8, the border line between the back surface 3B of the face portion 3 and the inner surface of the crown portion 4, sole portion 5 and side portion 6. If the back surface 3B and the inner surface are connected through an arc, the edge 3*e* can be defined as a midpoint of the length of the arc in the cross section of the head for the sake of simplicity.

The horizontal distance L1 between the extension K1 of the crown-side thick part 11 and the centroid Zc of the central thick part 10, and the horizontal distance L2 between the extension K2 of the sole-side thick part 12 and the centroid Zc of the central thick part 10 are each set in a range of not less than 3 mm, preferably not less than 4 mm, more preferably not less than 5 mm, but not more than 12 mm, preferably not more than 11 mm, more preferably not more than 10 mm.

If the distance L1 and/or distance L2 are/is more than 12 mm, there is a possibility that the face portion 3 can not be reinforced effectively. If less than 3 mm, the carry distance on miss shots is liable to decrease.

In the front view of the head under the standard state as shown in FIG. 6, it is preferable that the widthwise center line (extension K1) of the crown-side thick part 11 is inclined to the toe from the crown towards the sole at an angle θ1 in a range of from 10 to 40 degrees with respect to the vertical direction, and the widthwise center line (extension K2) of the sole-side thick part 12 is also inclined to the toe from the crown towards the sole at an angle θ2 in a range of from 10 to 40 degrees with respect to the vertical direction.

More preferably, the angles θ1 and θ2 are not less than 15 degrees, still more preferably not less than 20 degrees, but not more than 35 degrees, still more preferably not more than 33 degrees, most preferably not more than 30 degrees. As a result, the durability of the face portion 3 can be further improved.

If the angles θ1 and θ2 are less than 10 degrees or more than 40 degrees, the effect to reinforce the face portion 3 decreases.

Preferably, the absolute value $|\theta 1-\theta 2|$ of the difference between the angles θ1 and θ2 is not more than 10 degrees, more preferably not more than 5 degrees, still more preferably not more than 3 degrees. In other words, the two widthwise center lines are substantially parallel with each other.

In the front view under the standard state, the crown-side thick part 11 and sole-side thick part 12 each have a width Wr of less than the maximum width Wc of the central thick part 10. As a result, the improvement in the durability and the weight reduction of the face portion 3 are compatible with each other.

Here, the width Wr of the crown-side thick part 11 is defined by a value measured at the position of its centroid Zu perpendicularly to the widthwise center line.

The width Wr of the sole-side thick part 12 is defined by a value measured at the position of its centroid Zd perpendicularly to the widthwise center line.

The maximum width Wc of the central thick part 10 is defined by a maximum width measured perpendicularly to the direction inclined at the mean value $\{(\theta 1+\theta 2)/2\}$ of the angles θ1 and θ2 of the two widthwise center lines.

The ratio (Wr/Wc) is preferably set in a range of not less than 0.18, more preferably not less than 0.23, but not more than 0.35, more preferably not more than 0.30.

As a result, an excessive increase in the coefficient of restitution can be prevented, while maintaining the strength of the central region of the face portion 3.

Each of the crown-side thick part 11 and sole-side thick part 12 is arranged such that the minimum distance between its centroid Zu, Zd and the extension K1,K2 becomes not more than 5 mm, preferably not more than 3 mm, more preferably not more than 1 mm.

In each of the thick parts 11 and 12, the width Wr is substantially constant along the widthwise center line, and smaller than the length of the widthwise center line.

But, it is also possible to vary the width Wr, for example, the thick part 11 and/or thick part 12 can be gradually increased in the width Wr towards the central thick part 10 and/or toward the edge 3*e* of the back surface 3B of the face portion 3.

In this embodiment, the crown-side thick part 11 and sole-side thick part 12 have the same width Wr. However, for example, the sole-side thick part 12 can be formed as being wider than the crown-side thick part 11 in order to improve the durability or strength.

The total area (Sru+Srd) of the thick parts 11 and 12 is preferably not less than 4%, more preferably not less than 6%, but not more than 12%, more preferably not more than 10% of the overall area of the back surface 3B of the face portion 3. If the total area is less than 4%, it becomes difficult to effectively increase the durability of the face portion 3 in the crown-sole direction. If the total area is more than 12%, there is a possibility that the coefficient of restitution and the directionality of hit balls deteriorate.

The above-mentioned toe-side thinner parts 13 in this example comprises: a toe-side-middle minimum-thickness part 13*a* disposed on the toe-side of the central thick part 10; a toe-side-upper medium-thickness part 13*b* disposed between the part 13*a* and the crown-side thick part 11; and a toe-side-lower medium-thickness part 13*c* disposed between the part 13*a* and the sole-side thick part 12.

The above-mentioned heel-side thinner parts 14 in this example compress:

a heel-side-middle minimum-thickness part 14*a* disposed on the heel-side of the central thick part 10;

a heel-side-upper medium-thickness part 14*b* disposed between the part 14*a* and the crown-side thick part 11; and a heel-side-lower medium-thickness part 14*c* disposed between the part 14*a* and the sole-side thick part 12.

The thickness Tc of the central thick part 10, the thicknesses Tr of the crown-side thick part 11 and sole-side thick part 12, the thickness Tt of the toe-side-middle minimum-thickness part 13*a*, the thickness Th of the heel-side-middle minimum-thickness part 14*a*, the thicknesses Tto of the toe-side-upper medium-thickness part 13*b* and toe-side-lower medium-thickness part 13*c*, and the thicknesses Tho of the heel-side-upper medium-thickness part 14*b* and heel-side-lower medium-thickness part 14*c* satisfy the following conditional expressions (3) and (4):

$$Tc>=Tr>Tto>Tt \quad (3)$$

$$Tr>Tho>Th \quad (4)$$

The thicknesses Tt and Th of the minimum-thickness part 13*a* and 14*a* are preferably not less than 1.70 mm, more preferably not less than 1.85 mm, but not more than 2.30 mm, more preferably not more than 2.15 mm.

As a result, the weight of the face portion 3 can be reduced. Further, the deflection of the face portion 3 at the time of off-center shot towards toe or heel, is increased and the deterioration in the rebound performance is lessened.

If less than 1.70 mm, the durability of the face portion 3 is liable to become insufficient. If more than 2.30 mm, the deflection of the face portion 3 decreases, and the loss of the carry distance tends to increase.

The thicknesses Tr and Tr are each substantially constant.

The ratio (Tc/Tt) of the thickness Tc to the thickness Tt is preferably set in a range of from 1.40 to 2.00.

The ratio (Tc/Th) of the thickness Tc to the thickness Th is preferably set in a range of from 1.40 to 2.00.

If the ratios are increased, then the coefficient of restitution becomes increased, but there is a tendency that stress concentration occurs between the central thick part 10 and minimum-thickness parts 13*a*, 14*a*. If the ratios are decreased, then the coefficient of restitution tends to decrease.

The minimum-thickness parts 13*a* and 14*a* extend along the above-mentioned straight line N around which ball hitting positions of the average golfers concentrate.

For that purpose, in the front view of the head under the standard state as shown in FIG. 6, the minimum-thickness parts 13*a* and 14*a* are arranged such that a straight line K3 passing through the centroid SU1 of the toe-side-middle minimum-thickness parts 13*a* and the centroid SU2 of the heel-side-middle minimum-thickness parts 14*a* is inclined to the sole from the toe towards the heel at an angle θ3 of from 10 to 40 degrees, preferably 20 to 30 degrees with respect to the horizontal direction. The distance (m) between the straight line K3 and the sweet spot SS is not more than 10 mm, preferably not more than 5 mm, more preferably not more than 3 mm.

The width Wu of each of the minimum-thickness parts 13*a* and 14*a* measured at the centroid SU1, SU2 perpendicularly to the straight line K3 is preferably set in a range of not less than 7 mm, more preferably not less than 10 mm, but not more than 25 mm, more preferably not more than 20 mm.

As a result, the face portion is effectively deflected even when missed shot, and the loss of the carry distance is minimized. If the width Wu is less than 7 mm, then stress is liable to concentrate on the minimum-thickness part, and the durability is greatly decreased. If the width Wu is more than 25 mm, then the strength and durability are decreased at the interface between the minimum-thickness part 13*a*, 14*a* and the edge 3*e* of the back surface 3B of the face portion 3.

The total area (St+Sh) of the minimum-thickness parts 13*a* and 14*a* is preferably not less than 8%, more preferably not less than 9%, but not more than 20%, more preferably not more than 18% of the overall area of the back surface 3B of the face portion 3.

The ratio (St/Sh) is preferably in a range of from 0.8 to 1.2. If the total area is less than 8%, the deflection of the face portion 3 becomes insufficient when off-center shot toward the toe or heel is made and the coefficient of restitution is decreased. If the total area is more than 20%, the durability of the face portion 3 tends to deteriorate.

The thicknesses Tto of the toe-side medium-thickness parts 13*b* and 13*c* are more than the thickness Tt of the minimum-thickness part 13*a*, and less than the thicknesses Tr of the crown-side thick part 11 and the sole-side thick part 12. The thicknesses Tho of the heel-side medium-thickness parts 14*b* and 14*c* are more than the thickness Th of the minimum-thickness part 14*a*, and less than the thicknesses Tr of the crown-side thick part 11 and the sole-side thick part 12.

The medium-thickness parts 13*b*, 13*c*, 14*b* and 14*c* can decrease the stress concentrated on the minimum-thickness part and improve the durability of the face portion 3.

If the thickness Tto and Tho of the medium-thickness parts are decreased, then the durability of the club head tends to decrease, and further, there is a possibility that the coefficient of restitution is excessively increased and it becomes difficult to comply with golf rules.

If the thickness Tto and Tho are increased, then the coefficient of restitution is decreased, and the weight of the face portion 3 is increased.

Therefore, the thickness Tto and Tho of the medium-thickness parts are preferably not less than 1.90 mm, more preferably not less than 2.00 mm, but not more than 2.50 mm, more preferably not more than 2.35 mm.

In order to enhance the above-explained effects, the ratio (Tr/Tto) is preferably not less than 1.22, more preferably not less than 1.25, but not more than 1.50, more preferably not more than 1.45.

The ratio (Tr/Tho) is preferably not less than 1.22, more preferably not less than 1.25, but not more than 1.50, more preferably not more than 1.45.

The ratio (Tto/Tt) is preferably not less than 1.08, more preferably not less than 1.10, but not more than 1.24, more preferably not more than 1.21.

The ratio (Tho/Th) is preferably not less than 1.08, more preferably not less than 1.10, but not more than 1.24, more preferably not more than 1.21.

In order to improve the durability and coefficient of restitution of the face portion 3 in a well balanced manner, the total area (Stu+Std+Shu+Shd) of the area Stu of the toe-side-upper medium-thickness parts 13*b*, the area Std of the toe-side-lower medium-thickness parts 13*c*, the area Shu of the heel-side-upper medium-thickness parts 14*b*, and the area Shd of the heel-side-lower medium-thickness parts 14*c* is preferably not less than 28%, more preferably not less than 30%, but not more than 51%, more preferably not more than 49% of the overall area of the back surface 3*e* of the face portion 3.

Furthermore, in order to prevent stress concentration and improve the durability of the face portion 3, thickness transitional parts are provided.

Figure 9:
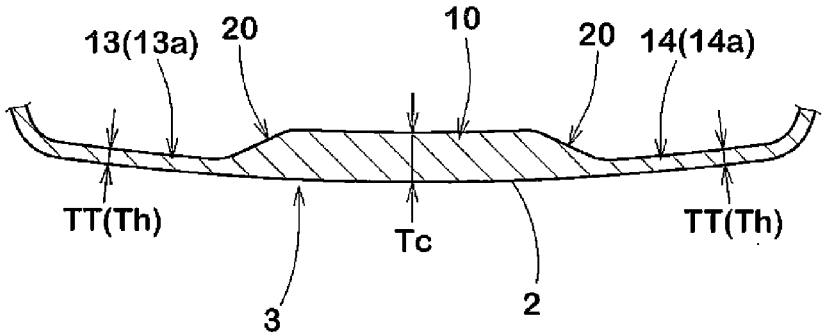
FIG. 9 is a cross sectional view taken along line B-B of FIG. 6.
Figure 11:
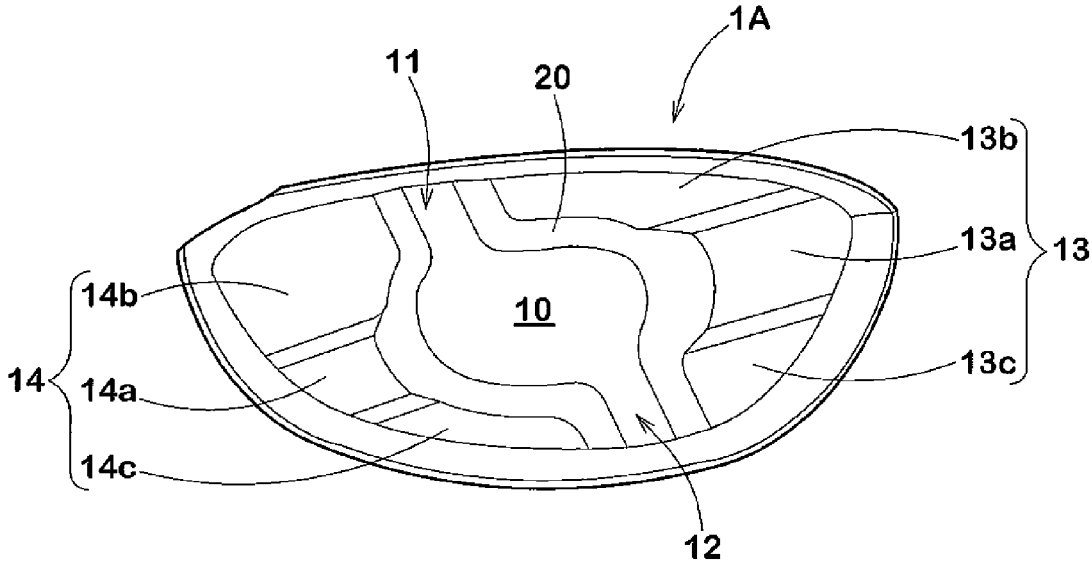
FIG. 11 is a rear view of the face portion provided with another example of the patterned indentation similar to FIG. 7.

As shown in FIG. 7 and FIG. 9, a first thickness transitional part 20 whose thickness decreases continuously from the central thick part 10 towards the edge He of the back surface 3B of the face portion 3 is provided around the central thick part 10. As shown in FIG. 11, in the case that the thickness of the central thick part 10 is the same as the thicknesses Tr of the crown-side thick part 11 and the sole-side thick part 12, the first thickness transitional part 20 is broken apart by crown-side thick part 11 and sole-side thick part 12.

On the toe-side and heel-side of the crown-side thick part 11, there are provided a second thickness transitional part 21 whose thickness is decreased continuously from the crown-side thick part 11 to the medium-thickness part 13*b*, 14*b*.

On the toe-side and heel-side of the sole-side thick part 12, there are provided a third thickness transitional part 22 whose thickness is decreased continuously from the sole-side thick part 12 to the medium-thickness part 13*c*, 14*c*.

Figure 10:
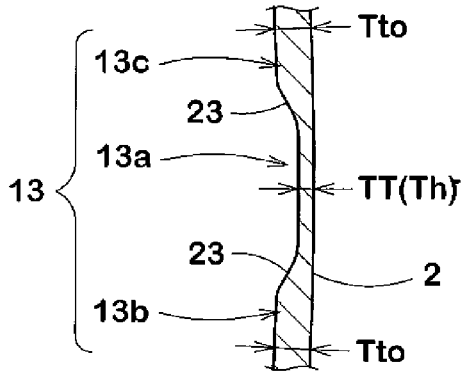
FIG. 10 is an enlarged cross sectional view taken along line C-C of FIG. 6.

Further, as shown in FIG. 10, on the upper side and lower side of the toe-side-middle minimum-thickness part 13*a*, there is provided a fourth thickness transitional part 23 whose thickness is increased continuously from the parts 13*a* to the medium-thickness part 13*b*, 13*c*.

On the upper side and lower side of the heel-side-middle minimum-thickness parts 14*a*, there is provided a fifth thickness transitional part 24 whose thickness is increased continuously from the part 14*a* to the medium-thickness part 14*b*, 14*c*.

Further, the maximum variation of the thickness, namely, the difference between the thickness Tc of the central thick part 10 and the thickness Tt, Th of the minimum-thickness part 13*a*, 14*a* is preferably less than 2.5 mm, more preferably less than 2.0 mm, still more preferably less than 1.7 mm.

Comparison Tests

Wood-type golf club heads were manufactured and tested for the durability and coefficient of restitution.

All of the heads had identical structures shown in FIGS. 1-4, except for the thickness distribution or the patterned indentation on the back surface of the face portion.

The specifications of the patterned indentations are shown in Table 1.

The main body was a lost-wax precision casting of a titanium alloy Ti-6Al-4V. The face plate was made by hot forging a titanium alloy Ti-6Al-4V. The face plate was fixed to the main body by Tig welding. The head volume was 460 cc. The overall area of the back surface of the face portion was 42.0 sq·cm.

Restitution Coefficient Test:

According to the "procedure for Measuring the velocity Ratio of a club Head for conformance to Rule 4-1e, Appendix II, Revision 2 (Feb. 8, 1999), United States Golf Association", the coefficient of restitution COR of each club head was obtained with respect to five hitting positions.

The five hitting positions were: the sweet spot SS; a top-side position and a sole-side position at a distance of 10 mm from the sweet spot along the clubface toward the upside and downside, respectively; and a toe-side position and a heel-side position at a distance of 20 mm from the sweet spot along the clubface toward the toe and heel, respectively.

The results are shown in Table 1, wherein the obtained OCR values of each head are indicated by an index for the head based on the value of the COR at the sweet spot being 100, and the larger value is better.

Durability Test:

The club heads were attached to identical carbon shafts ("SV-3003J", flex X manufactured by SRI Sports Limited) to make 45-inch wood clubs, and each club was mounted on a swing robot and hit golf balls 10,000 times (maximum) at the sweet spot at the head speed of 54 m/s, while visually checking the club head every 100 times. If any damage was observed, the number of hits was recorded. The test results are shown in Table 1.

From the test results, it was confirmed that, in the golf club heads Exs. 1, 2 and 3, the decrease in the coefficient of restitution from the value measured at the sweet spot to the values measured at the toe-side position and heel-side position was lessened, therefore, if ball hitting positions are off centered, loss of the carry distance can be lessened.

TABLE 1

Figure 12:
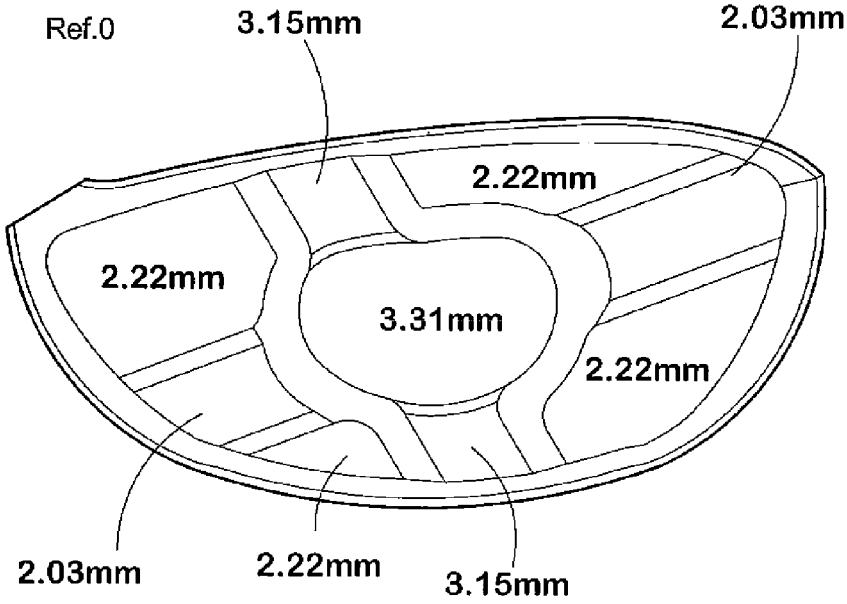
FIGS. 12-16 each shows the back surface of a face portion used in the undermentioned comparison tests.
Figure 13:
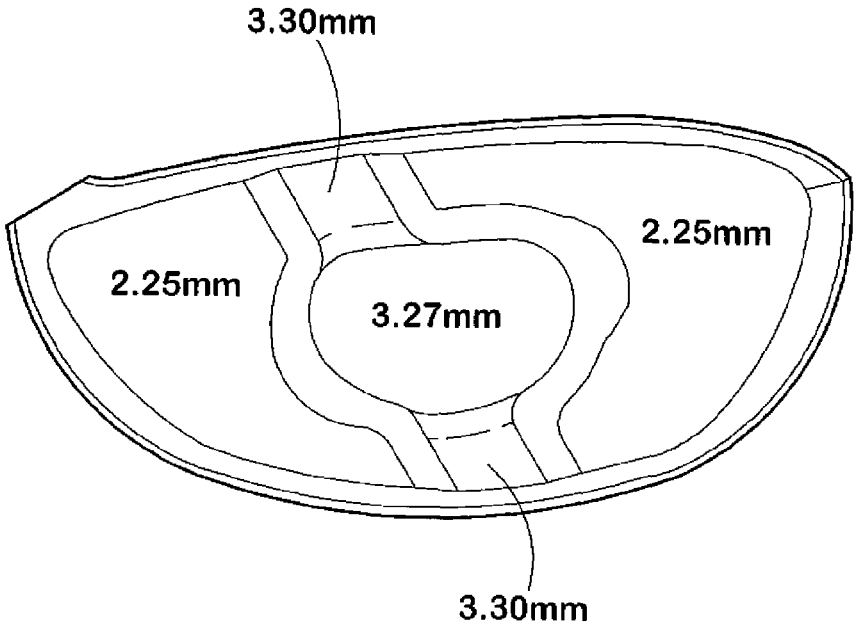
Figure 14:
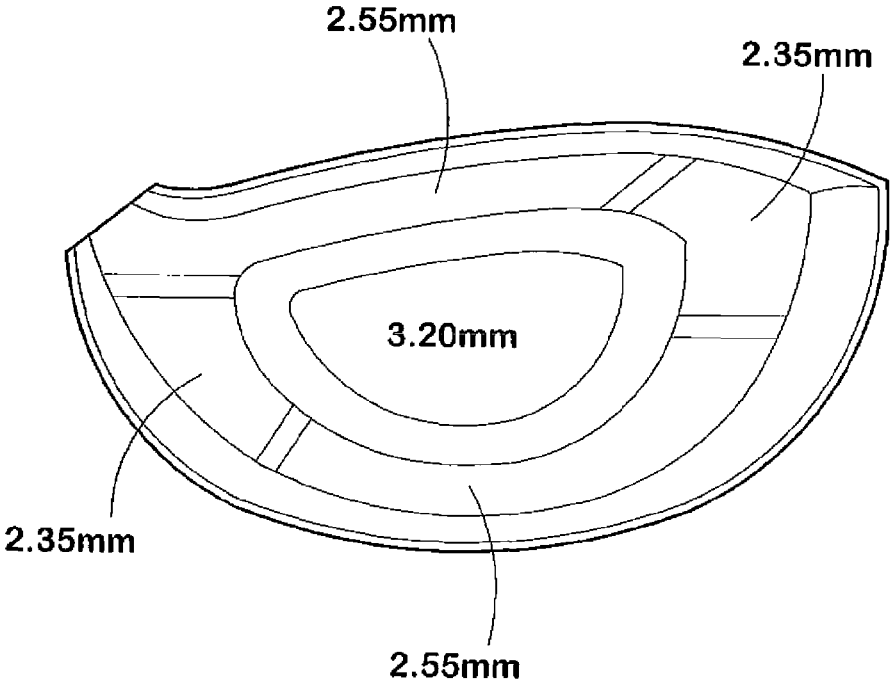
Figure 15:
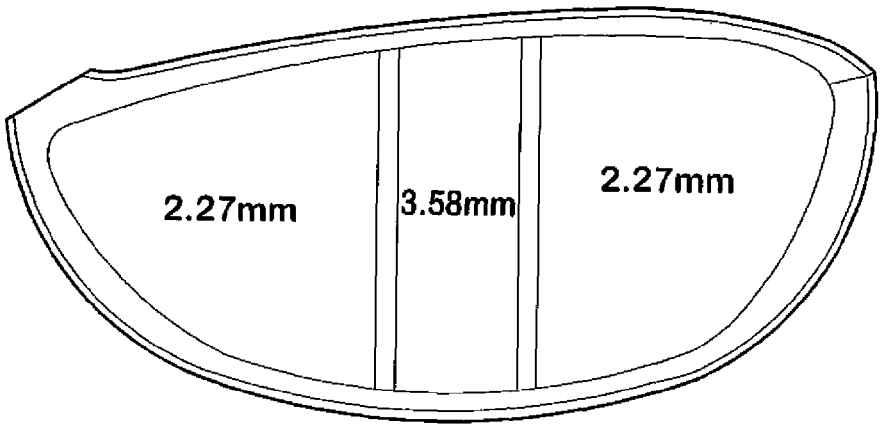
Figure 16:
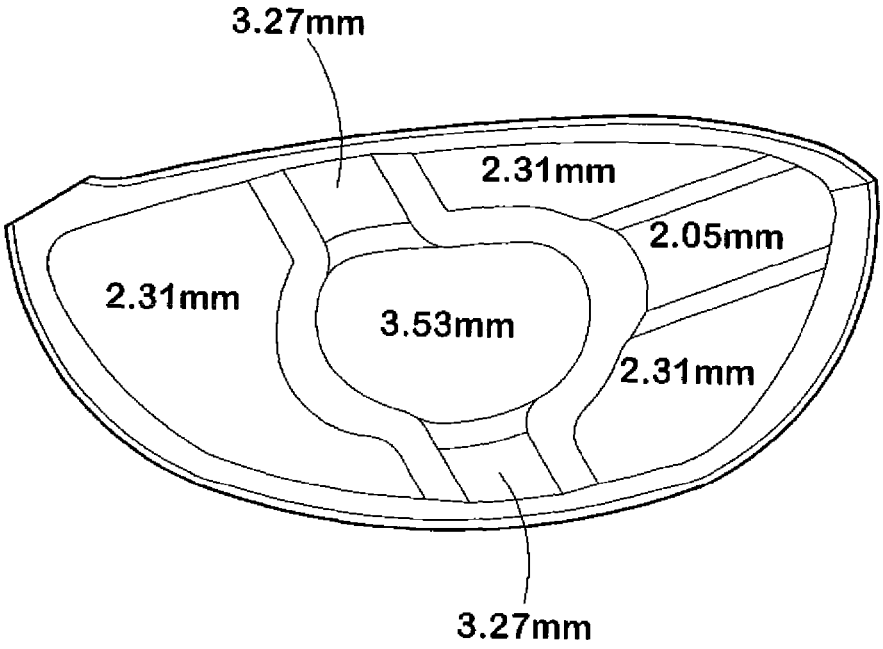

| | Head | | | | | | | |
|---|---|---|---|---|---|---|---|---|
| | Ex. 1 | Ex. 2 | Ex. 3 | Ref. 0 | Ref. 1 | Ref. 2 | Ref. 3 | Ref. 4 |
| | Back surface | | | | | | | |
| | FIG. 7 | FIG. 7 | FIG. 7 | FIG. 12 | FIG. 13 | FIG. 14 | FIG. 15 | FIG. 16 |
| Thickness (mm) | | | | | | | | |
| Tc: Central thick part | 3.26 | 3.30 | 3.21 | 3.31 | 3.27 | 3.20 | 3.58 | 3.53 |
| Tr: Crown and sole side thick parts | 3.05 | 3.10 | 3.00 | 3.15 | 3.30 | — | 3.58 | 3.27 |
| Tt, Th: Minimum-thickness parts | 1.90 | 1.95 | 1.86 | 2.03 | — | 2.35 | — | 2.05 |
| Tto, Tho: Medium-thickness parts | 2.05 | 2.00 | 1.95 | 2.22 | 2.25 | 2.55 | 2.27 | 2.31 |
| Tc/Tr | 1.07 | 1.06 | 1.07 | 1.05 | 0.99 | — | 1.00 | 1.08 |
| Tr/Tto, Tr/Tho | 1.49 | 1.55 | 1.54 | 1.42 | 1.47 | — | 1.58 | 1.42 |

TABLE 1-continued

| | Head | | | | | | | |
|---|---|---|---|---|---|---|---|---|
| | Ex. 1 | Ex. 2 | Ex. 3 | Ref. 0 | Ref. 1 | Ref. 2 | Ref. 3 | Ref. 4 |
| | Back surface | | | | | | | |
| | FIG. 7 | FIG. 7 | FIG. 7 | FIG. 12 | FIG. 13 | FIG. 14 | FIG. 15 | FIG. 16 |
| Tto/Tt, Tho/Th | 1.08 | 1.03 | 1.05 | 1.09 | — | 1.09 | — | 1.13 |
| Tc/Tt, Tc/Th | 1.72 | 1.69 | 1.73 | 1.63 | — | 1.36 | — | 1.72 |
| Angle θ1 of K1 (deg) | 25 | 20 | 20 | 20 | 20 | — | 0 | 20 |
| Angle θ2 of K2 (deg) | 25 | 30 | 20 | 20 | 20 | — | 0 | 20 |
| Distance L1 (mm) between K1 and Zc | 7.0 | 10.0 | 5.0 | 0 | 0 | — | 0 | — |
| Distance L2 (mm) between K2 and Zc | 8.0 | 10.0 | 5.0 | 0 | 0 | — | 0 | — |
| Area (sq. cm) | | | | | | | | |
| Sru: Crown-side thick part | 1.3 | 1.7 | 2.3 | 2.5 | 2.5 | | | 3.0 |
| Sc: Central thick part | 7.6 | 7.5 | 7.8 | 8.1 | 8.0 | 8.6 | — | 7.8 |
| Srd: Sole-side thick part | 1.4 | 1.7 | 2.0 | 2.5 | 2.5 | | | 2.7 |
| Stu: Toe-side-upper medium-thickness part | 5.1 | 4.4 | 4.0 | 3.5 | — | | | 3.0 |
| St: Toe-side-middle minimum-thickness part | 4.1 | 4.0 | 3.8 | 3.8 | 0 | | | 4.4 |
| Std: Toe-side-lower medium-thickness part | 3.2 | 3.5 | 4.0 | 6.0 | — | | | 4.5 |
| Shu: Heel-side-upper medium-thickness part | 6.5 | 6.7 | 6.0 | 6.2 | — | | | — |
| Sh: Heel-side-middle minimum-thickness part | 2.2 | 2.0 | 2.4 | 2.0 | 0 | | | — |
| Shd: Heel-side-lower medium-thickness part | 3.1 | 2.9 | 2.5 | 4.0 | — | | | — |
| Coefficient of restitution | | | | | | | | |
| Ball hitting position | | | | | | | | |
| Sweet spot | 100 | 100 | 100 | 100 | 100 | 100 | 100 | 100 |
| Toe-side | 87 | 86 | 85 | 85 | 80 | 65 | 75 | 90 |
| Heel-side | 82 | 81 | 82 | 80 | 70 | 60 | 65 | 65 |
| Crown-side | 82 | 80 | 78 | 75 | 70 | 70 | 70 | 70 |
| Sole-side | 85 | 83 | 82 | 80 | 75 | 75 | 70 | 75 |
| Durability | | | | | | | | |
| Number of hits | 10000 | 10000 | 10000 | 10000 | 10000 | 10000 | 7700 | 10000 |
| Damaged ? | no | no | no | no | no | no | yes *1 | no |

*1) face portion was broken

The invention claimed is:

1. A golf club head provided with a hollow structure comprising a face portion of which front surface forms a clubface, a crown portion, a sole portion and a side portion between the crown portion and sole portion, the face portion comprising: a central thick part; a crown-side thick part extending from the central thick part toward the crown portion; a sole-side thick part extending from said central thick part towards the sole portion; a toe-side thinner part formed on the toe-side of the crown-side thick part, central thick part and sole-side thick part; and a heel-side thinner part formed on the heel-side of the crown-side thick part, central thick part and sole-side thick part, wherein a thickness Tc of the central thick part, thicknesses Tr of the crown-side thick part and sole-side thick part, a thickness TT of the toe-side thinner part, and a thickness TH of the heel-side thinner part satisfy the following conditional expressions: (1) Tc >=Tr >TT, and (2) Tr >TH, and a centroid of the central thick part is positioned on the toe-side of an extension of a widthwise center line of the crown-side thick part towards the sole portion and on the heel-side of an extension of a widthwise center line of the sole-side thick part towards the crown portion, wherein the widthwise center line of the crown-side thick part and the widthwise center line of the sole-side thick part are each inclined to the toe from the crown towards the sole at an angle of from 10 to 40 degrees with respect to the vertical direction.

2. The golf club head according to claim 1, wherein a horizontal distance between the centroid of the central thick part and the extension of the widthwise center line of the crown-side thick part is in a range of from 3 to 12 mm, and a horizontal distance between the centroid of the central thick part and the extension of the widthwise center line of the sole-side thick part is in a range of from 3 to 12 mm.

3. The golf club head according to claim 1, wherein the toe-side thinner part comprises: a toe-side-middle minimum-thickness part positioned on the toe-side of the central thick part; a toe-side-upper medium-thickness part between the toe-side-middle minimum-thickness parts and the crown-side thick part; and a toe-side-lower medium-thickness part between the toe-side-middle minimum-thickness parts and the sole-side thick part, and the heel-side thinner parts comprises: a heel-side-middle minimum-thickness part positioned on the heel-side of the central thick part; a heel-side-upper medium-thickness part between the heel-side-middle minimum-thickness part and the crown-side thick part; and a heel-side lower medium-thickness part between the heel-side-middle minimum-thickness parts and the sole-side thick part, wherein said thickness Tc of the central thick part, said thicknesses Tr of the crown-side thick part and sole-side thick part, a thickness Tt of the toe-side-middle minimum-thickness part, a thickness Th of the heel-side-middle minimum-thickness part, thicknesses Tto of the toe-side-upper medium-thickness part and toe-side-lower medium-thickness part, and thicknesses Tho of the heel-side-upper medium-thickness part and heel-side-lower medium-thickness part satisfy the following conditional expressions: (3) Tc >=Tr >Tto >Tt, and (4) Tr >Tho >Th.

4. The golf club head according to claim 3, wherein a straight line passing through the centroid of the toe-side-middle minimum-thickness part and the centroid of the heel-side-middle minimum-thickness part is inclined to the heel from the crown towards the sole at an angle in a range of from 10 to 40 degrees with respect to the horizontal direction.

5. The golf club head according to claim 4, wherein the thickness Tc of the central thick part is in a range of from 3.10 to 4.00 mm, and the thicknesses Tto and Tho of the medium-thickness parts are in a range of from 1.90 to 2.50 mm.

6. The golf club head according to claim 3, wherein the thickness Tc of the central thick part is in a range of from 3.10 to 4.00 mm, and the thicknesses Tto and Tho of the medium-thickness parts are in a range of from 1.90 to 2.50 mm.

* * * * *